US008087455B2

(12) United States Patent
Miao et al.

(10) Patent No.: US 8,087,455 B2
(45) Date of Patent: Jan. 3, 2012

(54) RIB PLATE TYPE HEAT EXCHANGER

(75) Inventors: Zhixian Miao, Chao Yang District (CN); Xiang Ling, Jiangsu (CN); Faqing Niu, Wuxi (CN)

(73) Assignee: Wuxi Hongsheng Heat Exchanger Co. (CN)

( * ) Notice: Subject to any disclaimer, the term of this patent is extended or adjusted under 35 U.S.C. 154(b) by 671 days.

(21) Appl. No.: 12/281,344

(22) PCT Filed: Nov. 6, 2006

(86) PCT No.: PCT/CN2006/002969

§ 371 (c)(1), (2), (4) Date: Sep. 2, 2008

(87) PCT Pub. No.: WO2007/101376

PCT Pub. Date: Sep. 13, 2007

(65) Prior Publication Data

US 2009/0008071 A1 Jan. 8, 2009

(30) Foreign Application Priority Data

Mar. 9, 2006 (CN) ..... 2006 1 0038740

(51) Int. Cl.
*F28F 3/04* (2006.01)

(52) U.S. Cl. ..... 165/167; 165/78

(58) Field of Classification Search ..... 165/78, 165/167, 916

See application file for complete search history.

(56) References Cited

U.S. PATENT DOCUMENTS 2,865,613 A * 12/1958 Egenwall et al. ..... 165/167
4,630,674 A 12/1986 Skoog
4,781,248 A * 11/1988 Pfeiffer ..... 165/167
4,987,955 A * 1/1991 Bergqvist et al. ..... 165/167
5,226,474 A 7/1993 Hallgren
5,924,484 A 7/1999 Andersson et al.
5,971,065 A * 10/1999 Bertilson et al. ..... 165/167
5,992,510 A * 11/1999 Kallrot ..... 165/78

(Continued)

FOREIGN PATENT DOCUMENTS

CN 1667340 9/2005
WO 85/02670 6/1985

*Primary Examiner* — Leonard R Leo

(74) *Attorney, Agent, or Firm* — Schmeiser, Olsen & Watts, LLP

(57) ABSTRACT

A rib plate type heat exchanger comprises a heat exchange core consisting of rib plate type heat exchange plates. A surrounding edge of the rib plate type heat exchange plate is formed as a sealing bevel. The rib plate type heat exchange plate comprises the first end zone, the second end zone and a central heat exchange zone. The first and second distribution zones are provided in the first and the second end zones respectively. The central heat exchange zone and first and second distribution zones are arranged on a same plane and are extended in the height of a lower plate plane. Heat exchange ribs and flow guide ribs are provided in the central heat exchange zone and the distribution zones respectively. Corner holes which are surrounded by adjacent edge zones at the upper plate plane height and lower plate plane height are provided in the first end zone and the second end zone. There are incline intermediate zones extending between the adjacent edge zones, between the adjacent edge zone at the upper plate plane height and the central heat exchange zone, and between the adjacent edge zone at the upper plate plane height and the first and second distribution zones.

7 Claims, 13 Drawing Sheets

U.S. PATENT DOCUMENTS 6,926,076 B2 8/2005 Blomgren
2001/0030043 A1* 10/2001 Gleisle et al. ..... 165/167
2002/0050347 A1* 5/2002 Hainley et al. ..... 165/167
2008/0223564 A1* 9/2008 Bjornsson et al. ..... 165/167

* cited by examiner

RIB PLATE TYPE HEAT EXCHANGER

BACKGROUND OF THE INVENTION

At present, plate heat exchangers are often used in the media condensing, evaporating and mutual heat exchange processes. The heat exchange plates forming the plate heat exchangers are usually connected and sealed by welding or brazing and the use of adhesives or sealing gaskets between the plates.

In SE-B-415928, a plate heat exchanger comprising many heat exchange plates was announced, in which each heat exchange plate comprises the first end zone with the first and second corner holes, the second end zone and the central heat exchange zone extending from the first end zone to the second end zone, and the central heat exchange zone is corrugated; the corner holes as the inlet and outlet of the same fluid are located on the same side of the heat exchange plate.

In WO85/02670, a plate heat exchanger consisting of many heat exchange plates was announced, in which each heat exchange plate comprises the first end zone with the first and second corner holes, the second end zone and the central heat exchange zone extending from the first end zone to the second end zone, and the central heat exchange zone is corrugated; the central heat exchange zone extends from first end zone to second end zone; the said corner holes used as the inlet and outlet of the same fluid are located on the same side of the heat exchange plate; the first distribution zone extends in the first end zone, and the second distribution zone extends in the second end zone; in the said distribution zones there are some convexes arranged in a regular order, and because of these convexes, the flow resistance of heat exchange media in the gap between distribution zones is less than that in the gap between plates in the central heat exchange zone.

The deficiency of the above-mentioned plate heat exchanger is: when the heat exchange plates are arranged by stacking with each other and connected and sealed together, the support between the central heat exchange zone of each layer and the mechanical resistance to working pressure depends on the limited mutual contact points between the corrugated ridge lines and the property of the connecting substance between the contact points, and the shape, quantity and distribution status of these contact points depend not only on the need to satisfy the heat exchange media, but also on the mechanical performance of the materials used to make the heat exchange plates. If some materials are relatively weak but must be used for their special properties, or materials with relatively low mechanical performance are used to make heat exchange plates, and when some connecting and sealing materials with special properties have to be used, the service requirements may not be met in resistance against rupture pressure and anti-fatigue life in this type of plate heat exchangers because of insufficient contact points formed by corrugated elements between the central heat exchange zones.

Another deficiency of this type of plate heat exchanger is: each corrugated central heat exchange zone on each heat exchange plate is made with fixed die set by hydraulic forming, and after completion of fabrication with die set, the corrugation distribution on the central heat exchange zone in the heat exchange plate cannot be changed, therefore, heat exchange can be realized only with the central heat exchange zone of the same corrugation distribution even when different heat exchange media are used. Therefore, in the present manufacture of plate heat exchangers, heat exchange plates with central heat exchange zones of different corrugation distribution are made to meet requirements for different heat exchange media, which however will increase the manufacture cost of products.

SUMMARY OF THE INVENTION

The general object of this invention is to overcome the above-mentioned deficiencies by providing a rib plate type heat exchanger, which can resist fairly high rupture pressure and have high resistance to fatigue, thus lowering the manufacture cost of heat exchangers while meeting the demand of heat exchange with different applications.

The rib plate type heat exchanger is realized with the following scheme:

A rib plate type heat exchanger, consisting of the heat exchange core comprising rib plate type heat exchange plates as well as the external baffles and nozzles; the rib plate type heat exchange plates forming the heat exchange core are connected and sealed by welding or brazing and by using adhesives or sealing gaskets between them, and on the rib plate type heat exchange plates, there are the first end zone, second end zone and central heat exchange zone, the first edge zone and second edge zone around the rib plate type heat exchange plates form a sealing bevel, the rib plate type heat exchange plates extend between the first edge zone and second edge zone parallel with the upper plate and lower plate planes; in the rib plate type heat exchange plate, there is the first distribution zone in the first end zone, and the second distribution zone in the second end zone; in the first and second distribution zones there are flow guide ribs; the central heat exchange zone extends between the first edge zone and second edge zone to the first end zone and second end zone, and there are heat exchange ribs in the central heat exchange zone; the heat exchange ribs and flow guide ribs in the central heat exchange zone and in the first and second distribution zones are of the same height, and are also in the same height of the flow channels between the rib plate type heat exchange plates in the heat exchange core; the central heat exchange zone and the first and second distribution zones are at the same plane and extend at the elevation of the lower plate level; the heat exchange ribs are connected and fixed together with the central heat exchange zone plane, while the flow guide ribs are connected and fixed together with the plane of the first distribution zone and second distribution zone; in the first end zone and second end zone of the rib plate type heat exchange plate, there are through corner holes across the rib plate type heat exchange plate, and these corner holes are surrounded respectively by the corner hole adjacent edge zones at the height of the upper plate plane and the lower plate plane; these corner hole adjacent edge zones are in pairs in the first end zone and second end zone, and they extend respectively at the level of the upper plate plane height and lower plate plan level in the first end zone and second end zone; between these corner hole adjacent edge zones and between corner hole adjacent edge zones with upper plate plane height, including between corner hole adjacent edge zones with upper plate plane height and first distribution zone and second distribution zone, there is extension of incline intermediate zones, and the corner hole adjacent edge zones extending at the upper plate plane height are in contact with the lower plate plane height via the incline intermediate zone, and the corner hole adjacent edge zones extending at the lower plate plane height are in contact with the upper plate plane height via the incline intermediate zone.

The above-mentioned technical plan has the beneficial effect that: with the presence of the distribution zones in the first end zone and second end zone of the rib plate type heat exchange plate and the flow guide ribs in each distribution zone, the heat exchange media can have a fairly homogeneous distribution in the central heat exchange zones of various layers of the rib plate type heat exchanger comprising the rib plate type heat exchange plates The above-mentioned technical plan also has the beneficial effect that: because of fairly large contact and fixing areas between the heat exchange ribs and flow guide ribs and the rib plate type heat exchange plates, the rib plate type heat exchanger has fairly high resistance against rupture pressure and fairly good anti-fatigue ability.

The above-mentioned technical plan also has the beneficial effect that: in the above-mentioned rib plate type heat exchange plates and rib plate type heat exchanger, the heat exchange ribs and flow guide ribs can be one of the following five forms: sawtooth type, straight type, perorated type, corrugated type and shutter type, or the combination of them according to the properties of the heat exchange media and requirements; as different sizes and forms of ribs can be selected for the rib plate type heat exchange plates and in the rib plate type heat exchanger according to the properties of the heat exchange media and requirements, therefore the same rib plate type heat exchange plate and rib plate type heat exchanger can be used for more heat exchange media and conditions by selecting different forms of ribs.

As the further improvement of this invention, in the corner hole adjacent edge zones at the upper plate plane height of the rib plate type heat exchange plates, there is a concaved edge bubble with the bottom of the edge bubble reaching the lower plate plane height, and in the corner hole adjacent edge zones at the lower plate plane height, there is a convex edge bubble with the top of the edge bubble reaching the upper plate plane height.

The beneficial effects of the above-mentioned technical plan are: because of the homogeneous and intact concave and convex edge bubbles at the planes of the corner hole adjacent edge zones, these bubbles can not only ensure close contact and tight sealing between the planes of the corner hole adjacent edge zones during the manufacture, they can also enhance the anti-vibration and anti-fatigue performance of the sealing planes of the corner hole adjacent edge zones during the heat exchange operation of the rib plate type heat exchanger.

As the further improvement of the above-mentioned invention, on the rib plate type heat exchange plates, at the boundary between the ring enclosed sealing bevels around the corner hole adjacent edge zones and rib plate type heat exchange plates at the upper plate plane height, there are concave pits, with the bottom of the pits reaching the lower plate plane height; and at the boundary between the ring enclosed sealing bevels around the corner hole adjacent edge zones and rib plate type heat exchange plates at the lower plate plane height, there are convex bosses, with the top of the bosses reaching the upper plate plane height.

The beneficial effects of the above-mentioned technical plan are: with the concave pits and convex bosses between the sealing bevels at the planes of corner hole adjacent edge zones and rib plate type heat exchange plates, these pits and bosses can function to enable the tightening force produced during the mutual tightening of the rib plate type heat exchange plates to be conveyed between the continuous concave pits and convex bosses, thereby making the edges of corner hole adjacent edge zones close to each other to ensure plane sealing, and at the same time, during the heat exchange operation of this rib plate type heat exchanger, the concave pits and convex bosses can also enhance the anti-vibration and anti-fatigue performance of the sealing planes of the corner hole adjacent edge zones.

As the further improvement of this invention, on the straight section of enclosed ring sealed bevels of the first edge zone and second edge zone of the rib plate type heat exchange plates, turned up edge structure is provided to prevent deformation of this sealing bevel during fabrication, however, there is no such turned up edge structure at the four round corners of enclosed ring sealed bevels of each of the first edge zone and second edge zone of rib plate type heat exchange plates.

The above-mentioned technical provision can ensure that during the fabrication of each rib plate type heat exchange plate, the edge bevel shape is maintained without damage or rupture, and also, in the mutual tightening and in the connection and sealing process by welding or brazing, with the action of gravity and clamping force and the flow of sealing materials, the enclosed ring sealed bevels along the edge of the rib plate type heat exchange plates can change homogeneously and move in a parallel and homogeneous manner, so that all sealing faces remain closely contacted with each other at all times, to increase the on-spec rate of product.

As the further improvement of the above-mentioned invention, in the corner hole adjacent edge zones on the rib plate type heat exchange plates, there is a media distributor in at least one of the corner hole adjacent edge zones, and on the same rib plate type heat exchange plates, the diameter of the corner hole on corner hole adjacent edge zones with media distributors is smaller than the diameter of corner holes in other corner hole adjacent edge zones, therefore, when rib plate type heat exchange plates with media distributors form a rib plate type heat exchanger, the cold media can flow homogeneously via the media distributors on the rib plate type heat exchange plates into the channels of various plates of the rib plate type heat exchanger.

The above-mentioned media distributors can be set as: corner holes of the rib plate type heat exchange plates and their adjacent edge zones on the upper plate plane height, ring concave grooves are provided on the said adjacent edge zones, with the opening of the concave groove on the upper plate plane height and the bottom of the concave groove on the lower plate plane height; the edges of the concave grooves are arc-shaped, and small holes are provided in a staggered pattern on the inner and outer edges of the concave grooves.

The above-mentioned media distributors can also be set as: corner holes of the rib plate type heat exchange plates and their adjacent edge zones on the lower plate plane height, ring concave grooves are provided on the said adjacent edge zones, with the opening of the concave groove on the lower plate plane height and the bottom of the concave groove on the upper plate plane height; the edges of the concave grooves are arc-shaped, and small holes are provided in a staggered pattern on the inner and outer edges of the concave grooves.

The above-mentioned two types of media distributors can be set either separately on different rib plate type heat exchange plates, or on the same rib plate type heat exchange plate.

When a number of rib plate type heat exchange plates with media distributors are stacked together by mutually turning 180° and are connected and sealed to form the heat exchange core, the corner holes of the respective media distributors on the rib plate type heat exchange plates will be stacked together to form a corner hole flow passage with relatively smaller diameter, and on the adjacent rib plate type heat exchange plates, the small holes on all inner edges and on all outer edges will be aligned, and in the meanwhile, other corner holes without media distributors in these rib plate type heat exchange plates will form corner hole flow passages with relatively larger diameter.

When two rib plate type heat exchange plates with media distributors are assembled together, the top of the upper plane of the first rib plate type heat exchange plate is sealed and connected with the back of the lower plane of the second rib plate type heat exchange plate, so that the concave grooves on these two rib plate type heat exchange plates are placed in opposite to form a ring channel, and the evenly distributed heat exchange media will flow via the small holes on the inner side of the ring channel into this ring equalizing channel, and finally flow out of the ring channel from the small holes on the outer side of the ring channel, and to the flow guide ribs and heat exchange ribs, thus, the purpose of evenly distributing the heat exchange media between channels between various rib plate type heat exchange plates is achieved.

The above-mentioned technical plan has the beneficial effect that: as all rib plate type heat exchange plates are provided with media distributor and they form the rib plate type heat exchanger, when this rib plate type heat exchanger is used as heat exchanger for refrigerating or heat circulating purpose, the media can be evenly distributed by the media distributors on the rib plate type heat exchange plates and the equalizing channel into the flow channels between all rib plate type heat exchange plates.

A number of rib plate type heat exchange plates without media distributor are stacked together by mutually turning 180° and are connected and sealed to form the heat exchange core, or a number of rib plate type heat exchange plates with media distributors are stacked together by mutually turning 180° and are connected and sealed to form the heat exchange core; as the top of the corner hole adjacent edge zone at the upper plate plane height in the first end zone on each rib plate type heat exchange plate will be seal contacted with the back of the corner hole adjacent edge zone at the lower plate plane height in the second end zone on another rib plate type heat exchange plate, and in the meanwhile, the back of the corner hole adjacent edge zone at the lower plate plane height in the first end zone on each rib plate type heat exchange plate will be seal contacted with the top of the corner hole adjacent edge zone at the upper plate plane height in the second end zone on another rib plate type heat exchange plate, and because the corner hole adjacent edge zones at different level height are directly connected with the ring enclosed sealing bevels of the first edge zone and second edge zone around the rib plate type heat exchange plates, when the rib plate type heat exchange plates are stacked and connected and sealed together, corner hole flow channel space with height twice the rib height will be formed between the corner hole channels and the central heat exchange zone, so that the corner hole space will enhance the turbulence and erosive action of heat exchange media in this space, to avoid or mitigate stagnation of heat exchange media around the corner holes and deposit of foreign matter. Also, the corner hole channel space so formed can help evenly distribute the heat exchange media to central heat exchange zone at various layers and can also reduce the resistance to fluid.

In the above-mentioned heat exchange core formed by rib plate type heat exchange plates, as the corner hole channel edge zones have a corner hole channel space twice the rib height, the pressure at all points in the space of the same corner hole channel can be equal, and such a pressure distribution will be favorable to the anti-fatigue performance of the product and enhance the resistance of the product against rupture pressure.

In the above-mentioned rib plate type heat exchange plates, in the first end zone and second end zone on the rib plate type heat exchange plates, there are zero to four corner holes, and when the rib plate type heat exchange plates are stack assembled together in the required sequence and connected and sealed to form the heat exchange core, the corner holes in the heat exchange core will form corner hole flow passages, forming single or multiple passes of heat exchange media.

In the above-mentioned rib plate type heat exchange plates, the corner holes used as the inlet and outlet of the same fluid and the corner hole adjacent edge zones with the same plane height at the edge of these corner holes will be respectively located on a single same side in the first end zone and the second end zone, so that the heat exchange medium is distributed on the single same side in the rib plate type heat exchanger.

In the above-mentioned rib plate type heat exchange plates, the corner holes used as the inlet and outlet of the same fluid and the corner hole adjacent edge zones with the same plane height at the edge of these corner holes will be respectively located diagonally in the first end zone and the second end zone, so that the heat exchange medium is distributed in a diagonal pattern in the rib plate type heat exchanger.

The above-mentioned rib plate type heat exchanger can be manufactured with metal, non-metal or composite materials, to meet the requirements of different working pressure, working temperature and the heat exchange by heat exchange media with different corrosive properties.

DESCRIPTION OF THE PREFERRED EMBODIMENTS

Figure 1:
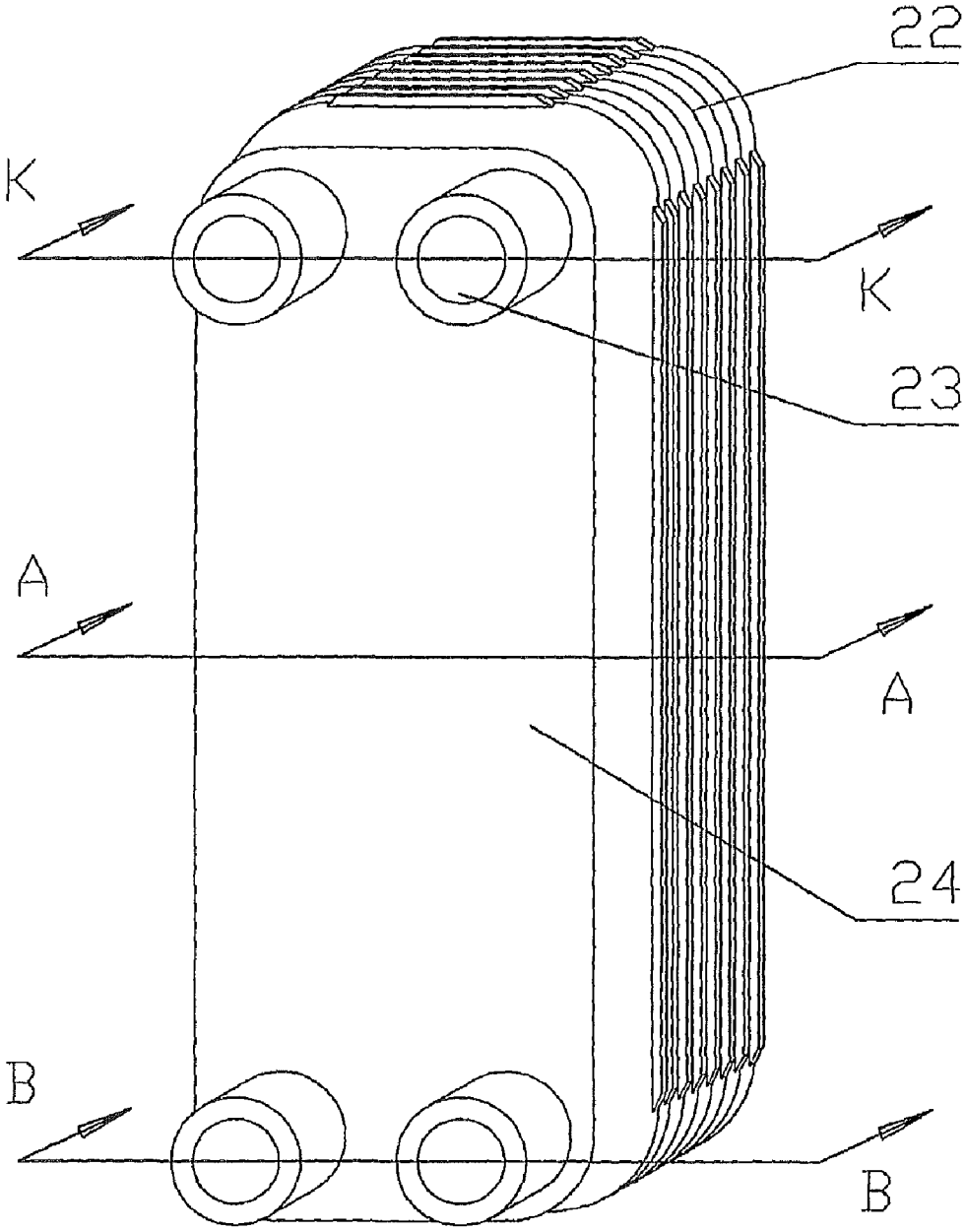
FIG. 1. is a perspective view of the invention.

The invention will further be described with reference to the accompanying drawing.

Presently preferred illustrative embodiments of invention are as follows.

Embodiment 1

Referring now to FIGS. 2, 3, 4 and 5, the rib plate type heat exchange plates 1 extends, between first edge zone 2 and second edge zone 3 and parallel with upper plate plane height 4 and lower plate plane height 5, the centerline 6 divides the rib plate type heat exchange plate 1 into the first part 11 and second part 12, the first edge zone 2 and second edge zone 3 along the edge of the rib plate type heat exchange plate 1 is the ring enclosed sealing bevel 21, and rib plate type heat exchange plate 1I also consists of: the first end zone 7; second end zone 8; central heat exchange zone 9, and it extends between first edge zone 2 and second edge zone 3 from the first end zone 7 to the second end zone 8; the central heat exchange zone 9 of the rib plate type heat exchange plate 1 extends on lower plate plane height 5, and on the central heat exchange zone 9 there are heat exchange ribs 13; in the first end zone and second end zone there are distribution zones 18 and 19, the first distribution zone 18 extends in the first end zone 7 at the lower plate plane height 5, the second distribution zone 19 extends in the second end zone 8 at the lower plate plane height 5; in the first distribution zone and second distribution zone are provided with flow guide ribs 20; the heat exchange ribs 13 and flow guide ribs 20 are of about the equal height.

Figure 2:
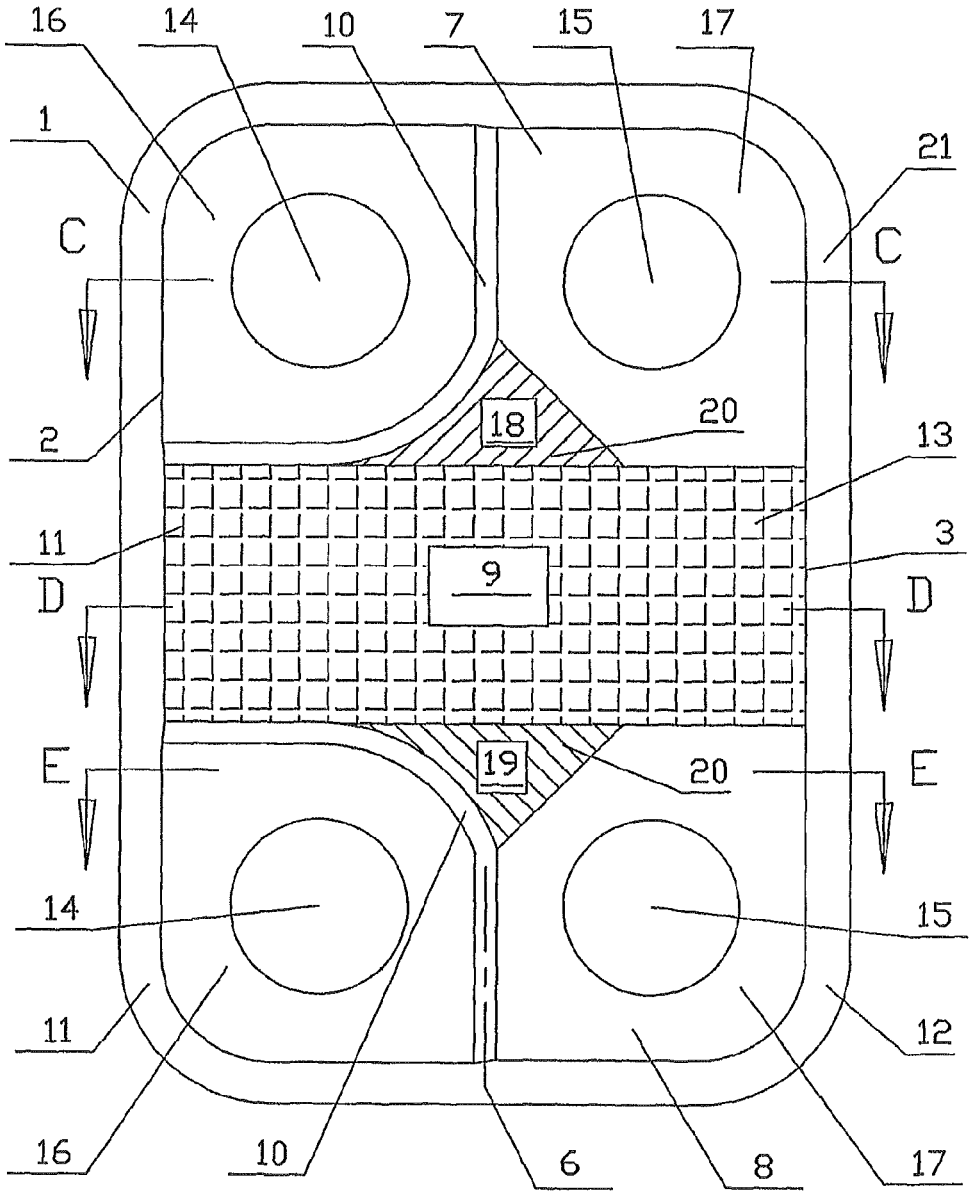
FIG. 2. is a front view of a rib plate type heat exchange plate in embodiment 1 of the invention.
Figure 3:
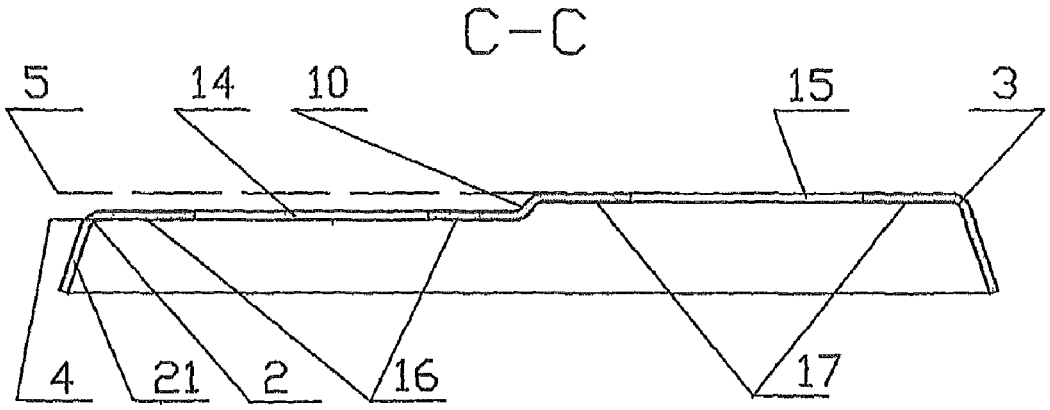
FIG. 3. is a transverse sectional view taken substantially as indicated along the line C-C of FIG. 2.
Figure 4:
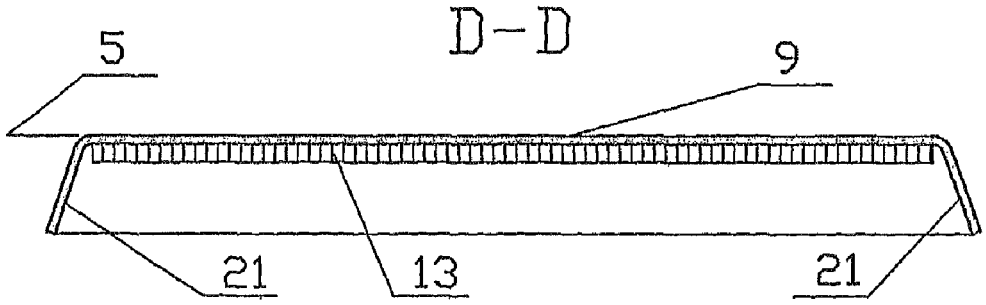
FIG. 4. is a transverse sectional view taken substantially as indicated along the line D-D of FIG. 2.
Figure 5:
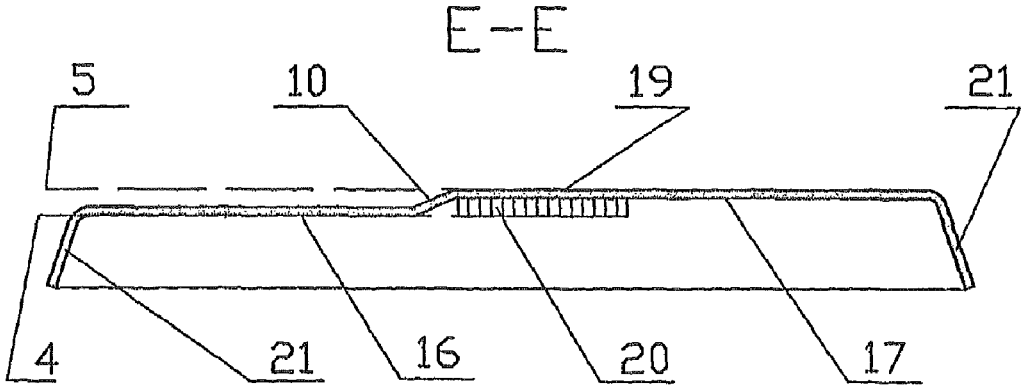
FIG. 5. is a transverse sectional view taken substantially as indicated along the line E-E of FIG. 2.

Referring now to FIGS. 2, 3 and 5, on rib plate type heat exchange plate 1 there are corner holes 14 and 15, corner holes 14 and 15 penetrate in first end zone 7 and second end zone 8 through rib plate type heat exchange plate 1 to form through holes, and are surrounded by their respective corner hole adjacent edge zone 16 and 17, the corner hole adjacent edge zone 16 around corner hole 14 extends at the upper plate level 4, and the corner hole adjacent edge zone 17 around corner hole 15 extends at the lower plate level 5.

Figure 19:
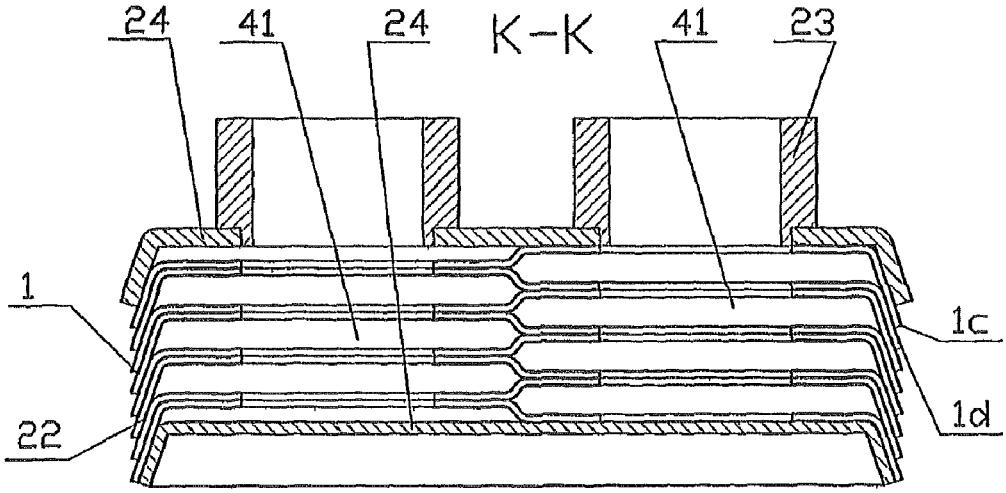
FIG. 19. is a transverse sectional view taken substantially as indicated along the line K-K of FIG. 1 with the rib plate type heat exchange plates in Embodiment 1 or Embodiment 3.

Referring now to FIG. 19, a second rib plate type heat exchange plate 1 is turned on the plane by 180° to stack with the first rib plate type heat exchange plate 1 and they are connected and sealed in succession in that order to form heat exchange core 22, and in heat exchange core 22, the corner holes 14 and 15 form corner hole flow passage 41; on heat exchange core 22 formed by rib plate type heat exchange plates 1 there are outer baffles 24, which are divided into front outer baffle 24 and rear outer baffle 24, and on the front outer baffle 24 there are through holes and nozzle 23.

Embodiment 2

Figure 6:
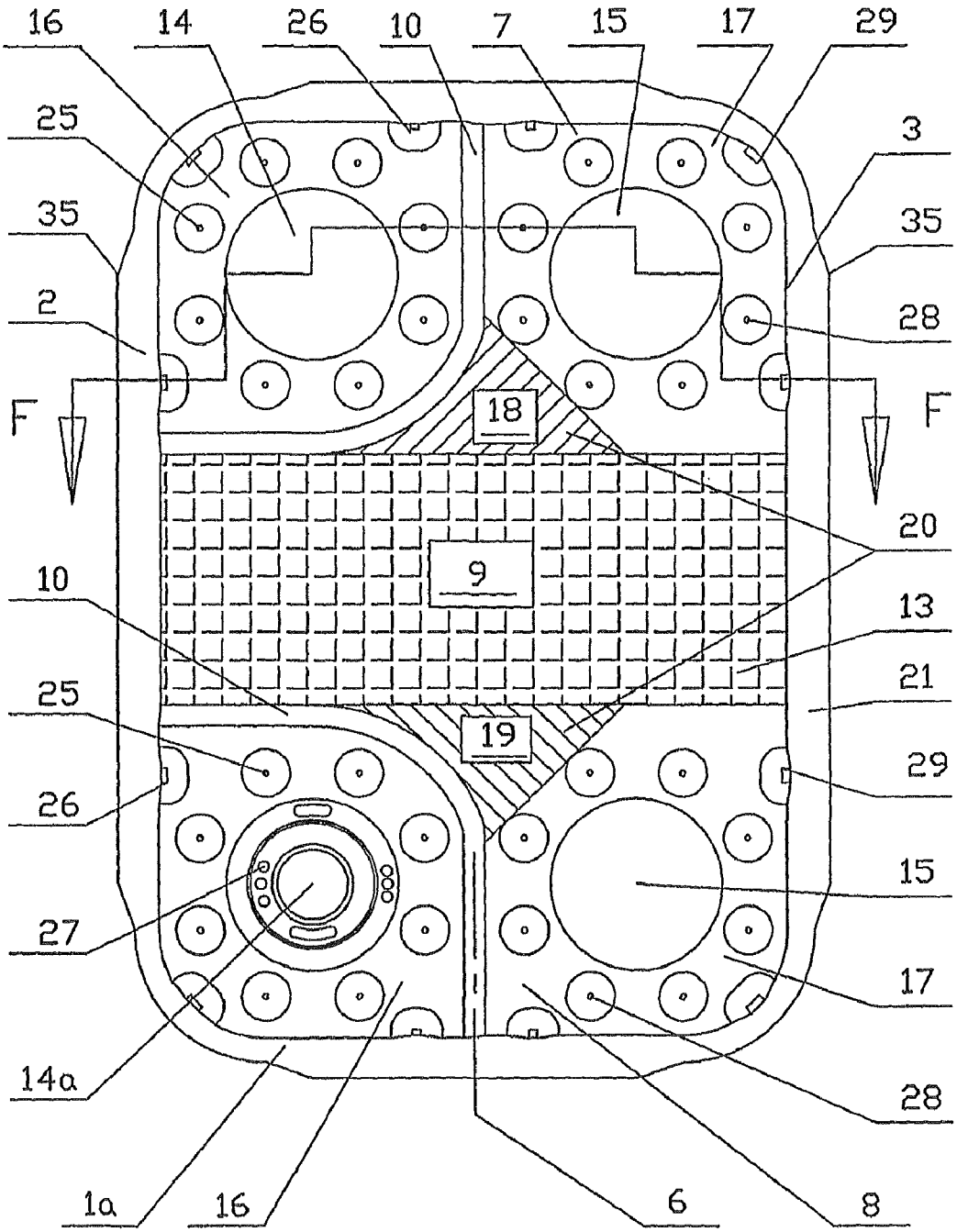
FIG. 6. is a view like FIG. 2 in embodiment 2 of the invention.
Figure 7:
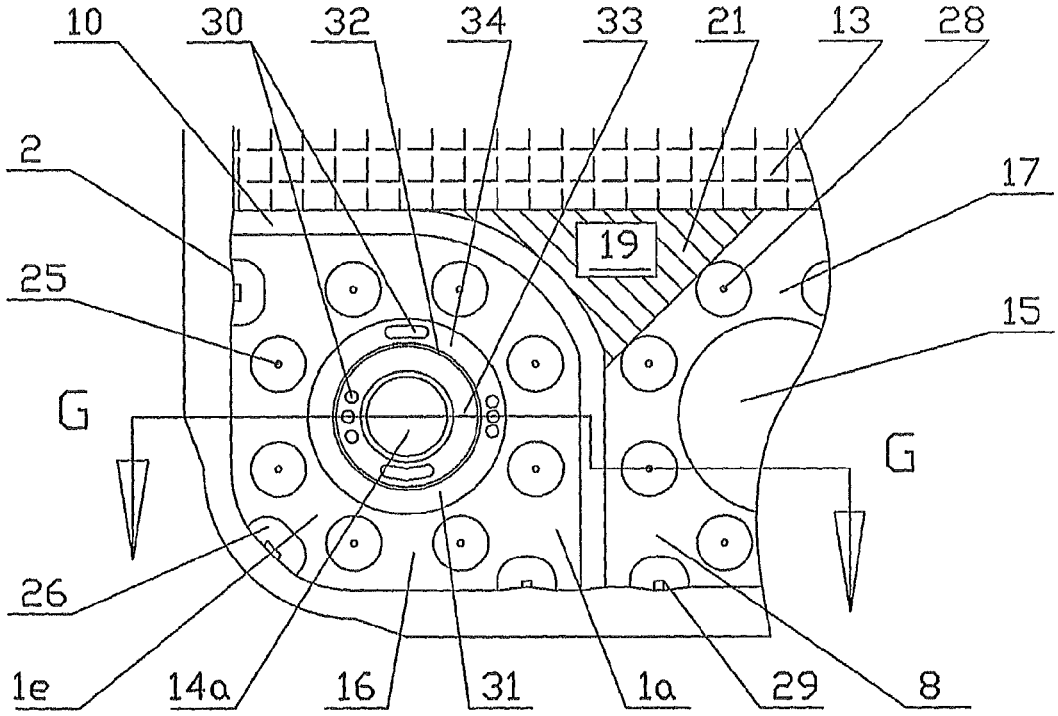
FIG. 7. is an enlarged schematic diagram of media distributor of FIG. 6 and FIG. 16.
Figure 8:
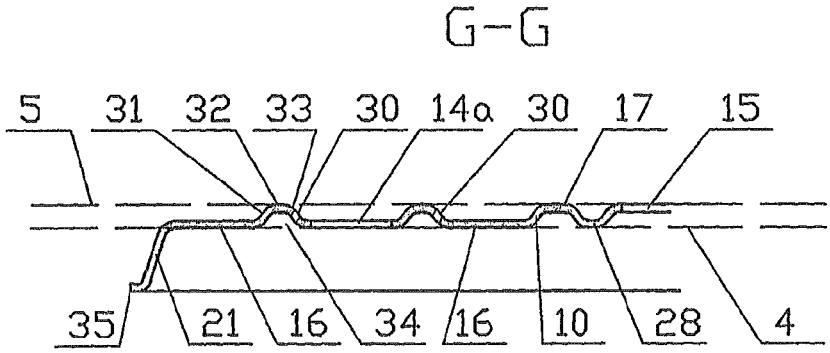
FIG. 8. is an enlarged schematic diagram of section G-G of FIG. 7.
Figure 9:
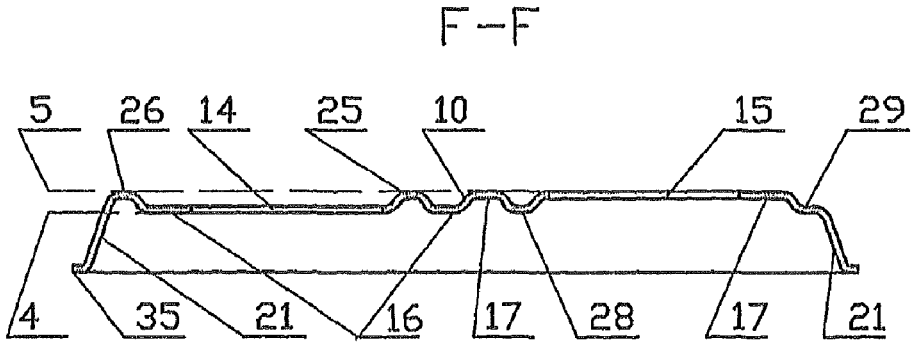
FIG. 9. is a transverse sectional view taken substantially as indicated along the line F-F of FIG. 6.

Embodiment 2 incorporates Embodiment 1 and has the following differences from Embodiment 1:

Referring now to FIGS. 6, 7 and 8, at corner hole 14 in the second end zone 8 on rib plate type heat exchange plate 1*a*, there is media distributor 27 and the corner hole 14*a*, corner hole 14*a* and the adjacent edge zone 16 are on the lower plate plane height 4, on adjacent edge zone 16 there is ring concave groove 32, its opening 34 is on lower plate plane height 4, and its bottom on upper plate plane height 5, The edges 33 and 31 of the concave groove 32 are curved, and on the inner and outer edges 33 and 31 of concave groove there is one or more equally spaced small holes 30, which are not in the same direction, and the position of these equally spaced small holes 30 are aligned with the equally spaced small holes 30 on the inner edge 38 and outer edge 36 on the adjacent rib plate type heat exchange plate 1*b* after assembling.

Figure 11:
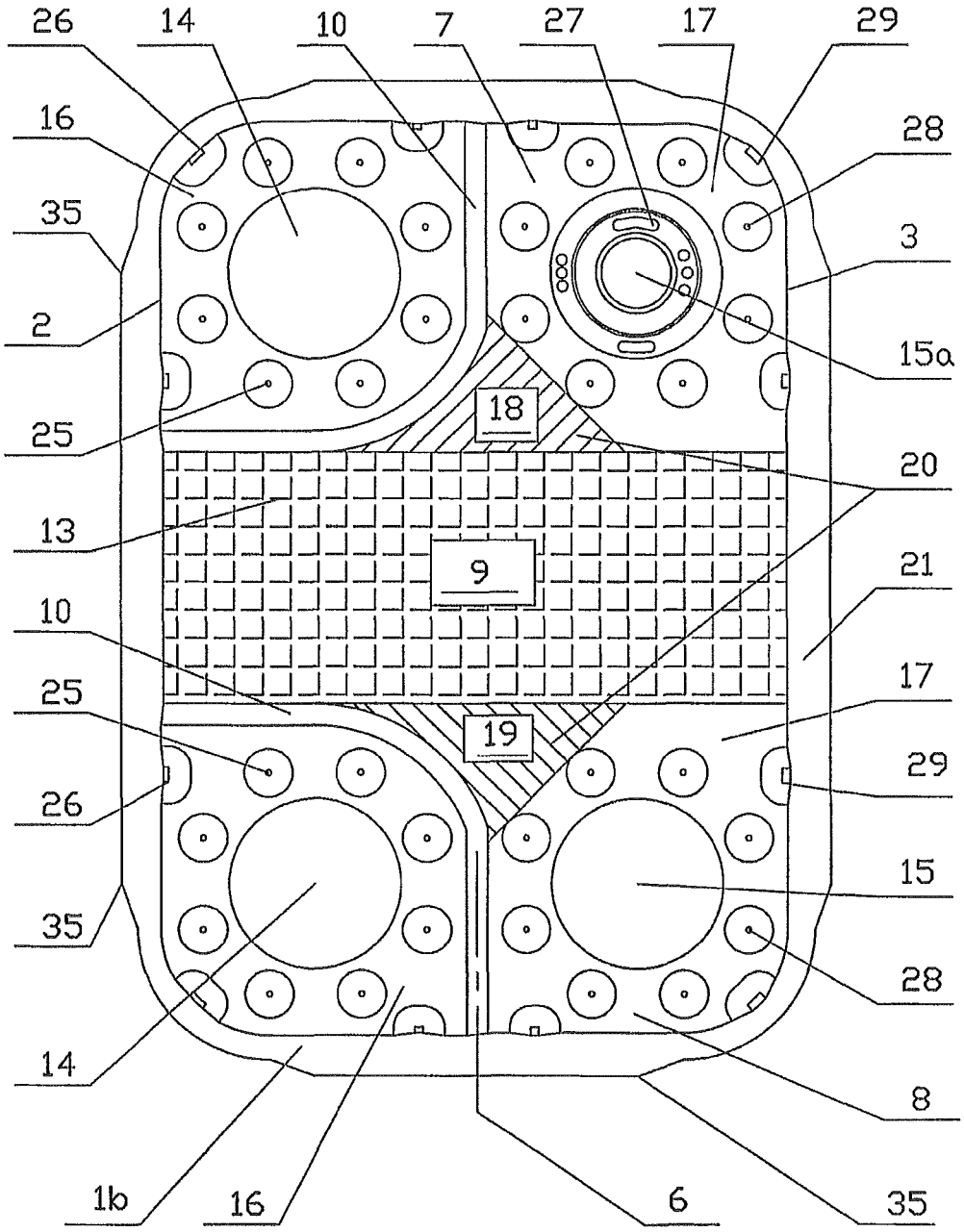
FIG. 11. is a view similar to FIG. 2 illustrating another rib plate type heat exchange plate in Embodiment 2.
Figure 12:
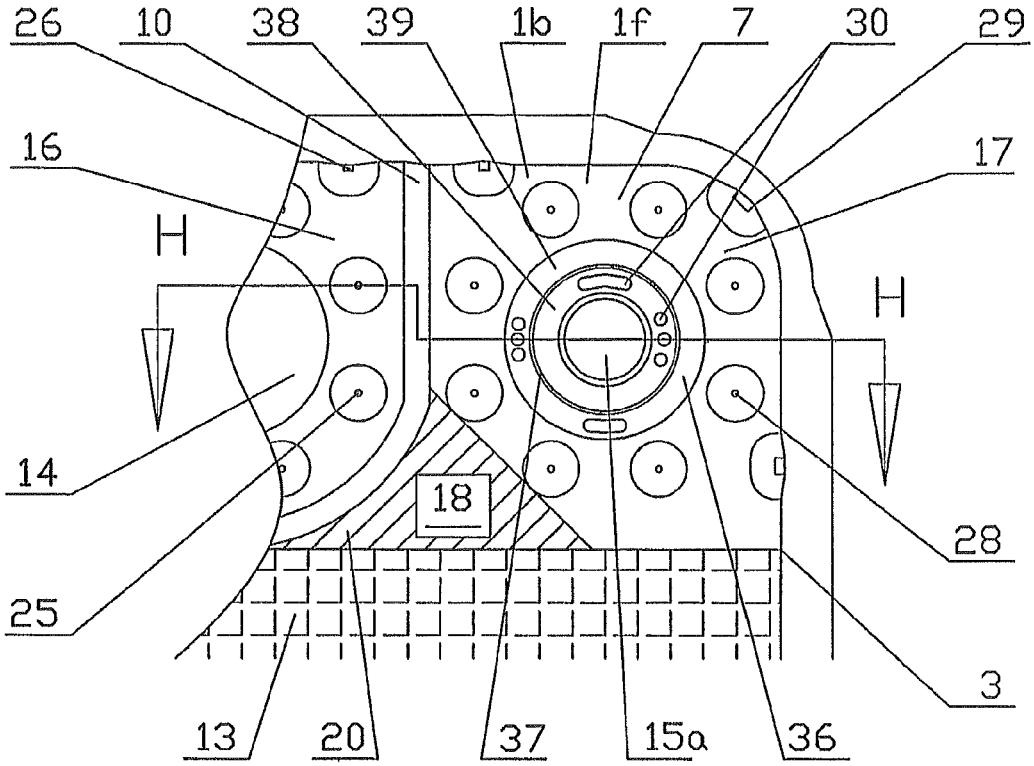
FIG. 12. is an enlarged schematic diagram of media distributor of FIG. 11 and FIG. 17.
Figure 13:
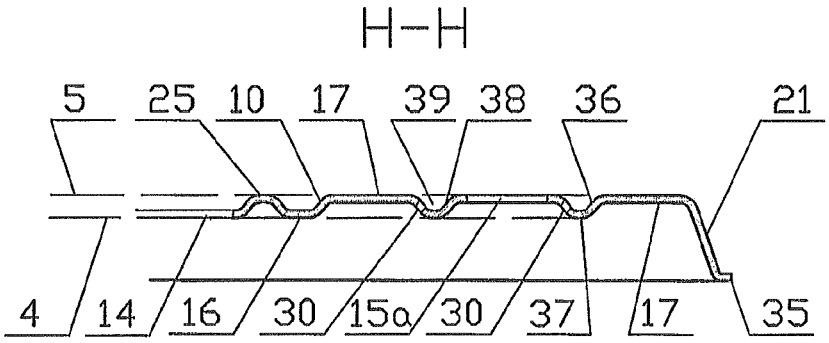
FIG. 13. is a transverse sectional view taken substantially as indicated along the line H-H of FIG. 12.

Referring now to FIGS. 11, 12 and 13, at corner hole 15 in the second end zone 7 on rib plate type heat exchange plate 1*b*, there is media distributor 27 and the corner hole 15*a*, corner hole 15*a* and the adjacent edge zone 17 are on the upper plate plane height 5, on adjacent edge zone 17 there is ring concave groove 37, its opening 39 is on upper plate plane height 5, and its bottom on lower plate plane height 4, The edges 38 and 36 of the concave groove 37 are curved, and on the inner and outer edges 38 and 36 of concave groove there is one or more equally spaced small holes 30, which are not in the same direction, and the position of these equally spaced small holes 30 are aligned with the equally spaced small holes 30 on the inner outer edges 33 and 31 on the adjacent rib plate type heat exchange plate 1*a* after assembling.

Referring now to FIGS. 6, 7, 8, 9, 11, 12 and 13, in the corner hole adjacent edge zone 16 along the corner holes 14 and 14*a* at upper plate plane height 4 there is a ring of concave edge bubbles 25, with the bottom of concave edge bubbles 25 reaching the lower plate plane height 5; in the corner hole adjacent edge zone 17 along the corner holes 15 and 15*a* at lower plate plane height 5 there is a ring of concave edge bubbles 28, with the top of concave edge bubbles 28 reaching the upper plate plane height 4; at the boundary between the corner hole adjacent edge zone 16 at upper plate plane height 4 and the sealing bevel 21 of the first edge zone 2 along rib plate type heat exchange plates 1*a* and 1*b* there are concave pits 26, with the bottom of the concave pits 26 reaching the lower plate plane height 5; at the boundary between the corner hole adjacent edge zone 17 at lower plate plane height 5 and the sealing bevel 21 of the second edge zone 3 along rib plate type heat exchange plates 1*a* and 1*b* there are convex bosses 29, with the top of the convex bosses 29 reaching the upper plate plane height 4.

Referring now to FIGS. 6, 7, 8, 9, 10, 11, 12, 13 and 18, on the straight section of the ring enclosed sealing bevel 21 along the first edge zone 2 and second edge zone 3 of each rib plate type heat exchange plate 1*a* and 1*b* are provided with edge turned up structure 35 to prevent deformation of the sealing bevel 21 during fabrication, however, at the four round corners of the ring enclosed sealing bevel 21 along the first edge zone 2 and second edge zone 3 of each rib plate type heat exchange plate 1*a* and 1*b* there is no such edge turned up structure 35.

Figure 18:
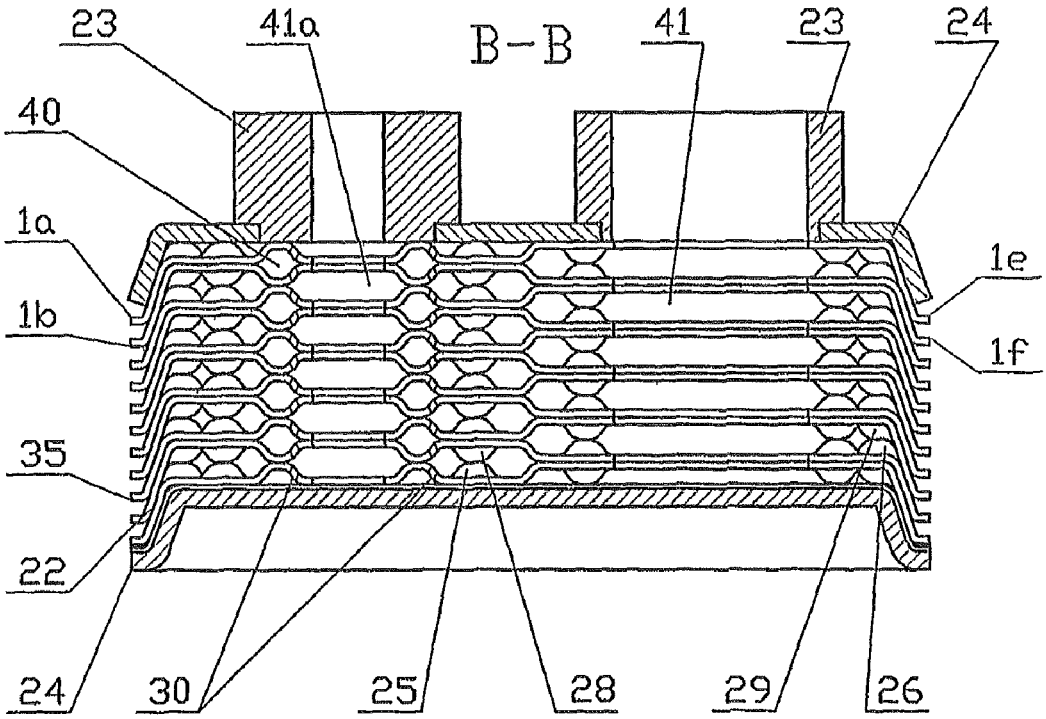
FIG. 18. is a transverse sectional view taken substantially as indicated along the line B-B of FIG. 1 with the rib plate type heat exchange plates in Embodiment 2 or Embodiment 4.

Referring now to FIGS. 6 and 11 and Attached FIG. 18, the rib plate type heat exchange plate 1*b* is turned on the plane by 180° and is stacked with rib plate type heat exchange plate 1*a* and be connected and sealed in succession in that order to form heat exchange core 22, in the heat exchange core 22 the corner holes 14 and 15 will form the corner hole flow passage 41, and corner holes 14*a* and 15*a* will form corner hole flow passage 41*a*, on the heat exchange core 22 formed by rib plate type heat exchange plates 1*a* and 1*b* is provided with outer baffle 24, which is divided into front outer baffle 24 and rear outer baffle 24, and on the front outer baffle 24 there is a through hole and the nozzle 23.

In the above-mentioned Embodiment 1 and Embodiment 2, the corner holes 14, 14*a* and 15, 15*a* used as the inlet and outlet of the same fluid in the rib plate type heat exchange plate 1 and rib plate type heat exchange plates 1*a* and 1*b*, and the corner hole adjacent edge zones 16 and 17 around these corner holes 14, 14*a* and 15, 15*a* with the same plane height are respectively located at the same single side in the first and second end zones, and the heat exchange media will flow and exchange heat mutually in the way of single same side flow in the rib plate type heat exchanger formed by the rib plate type heat exchange plate 1 and rib plate type heat exchange plates 1*a* and 1*b*.

Embodiment 3

Figure 14:
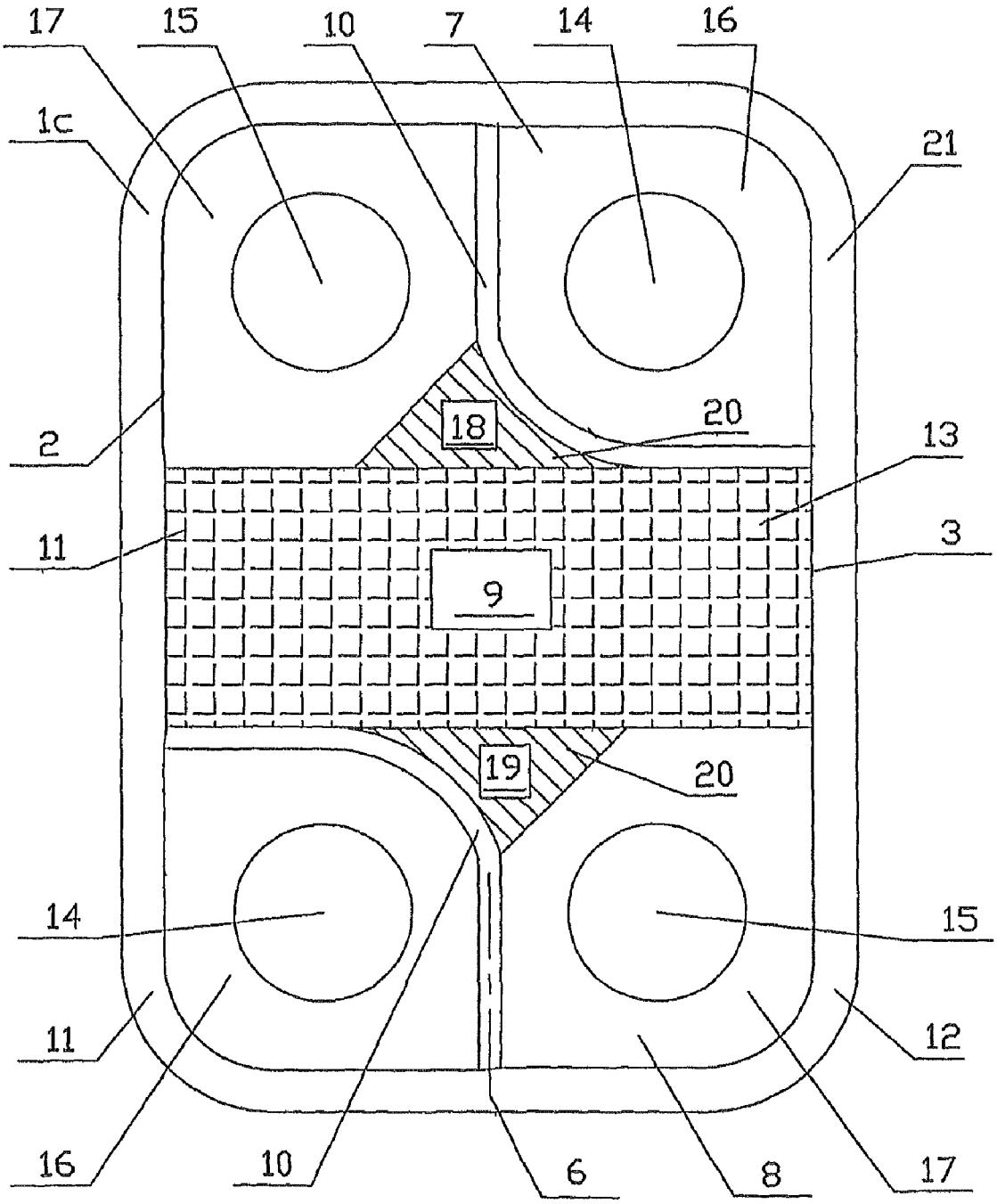
FIG. 14. is a view like FIG. 2 in Embodiment 3.
Figure 15:
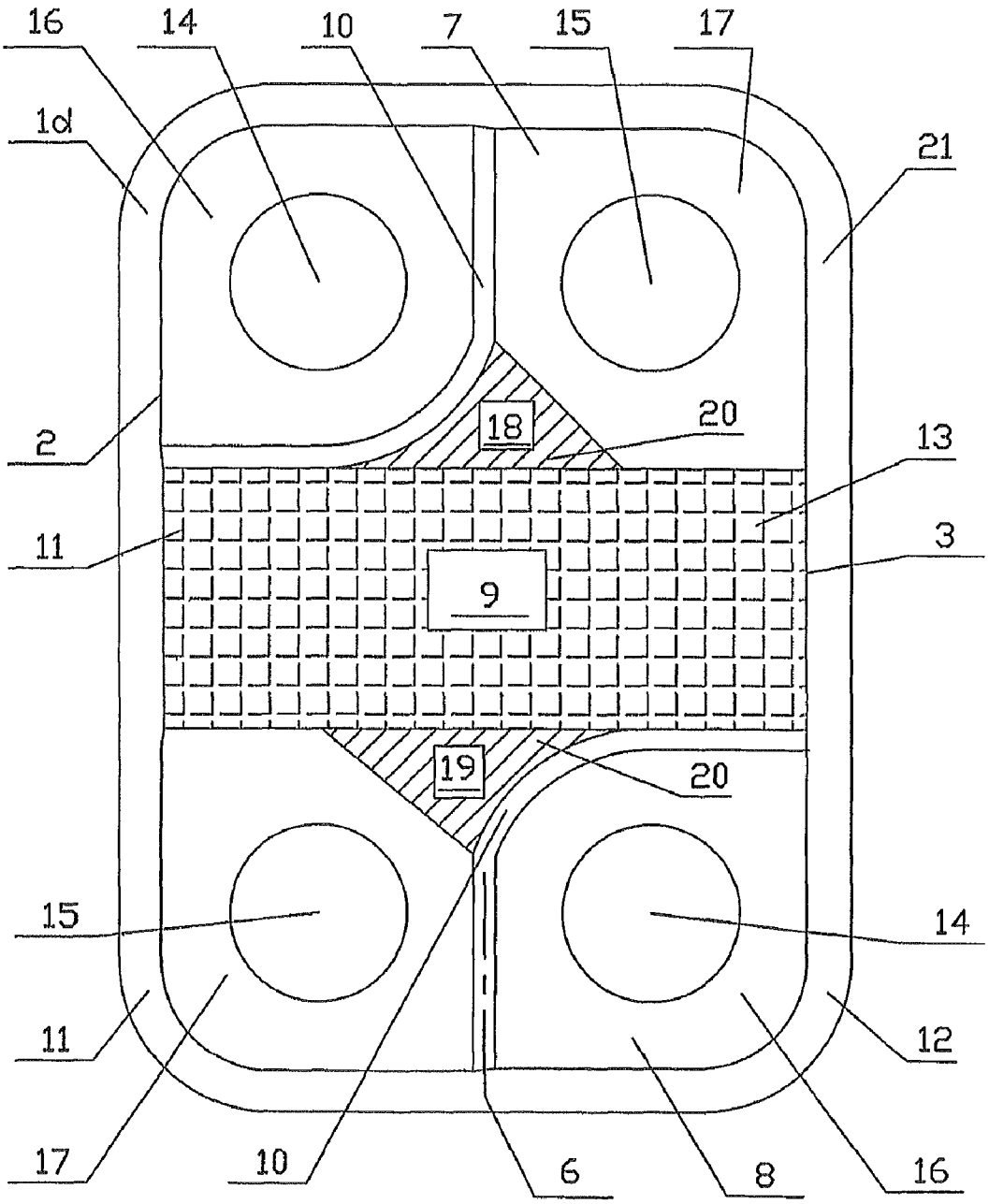
FIG. 15. is a view similar to FIG. 2 illustrating another rib plate type heat exchange plate in Embodiment 3.

Embodiment 3 is similar to Embodiment 1, with the following differences:

Referring now to FIGS. 14 and 15, the corner holes 14 and 15 used as the inlet and outlet of the same fluid of rib plate type heat exchange plates 1*c* and 1*d* and the corner hole adjacent edge zones 16 and 17 around these corner holes 14 and 15 at the same plane height are all located in the diagonal positions of rib plate type heat exchange plates 1*c* and 1*d*, and the heat exchange media will flow and exchange heat mutually in a diagonal pattern in the rib plate type heat exchanger formed by rib plate type heat exchange plates 1*c* and 1*d*.

Referring now to FIGS. 14 and 15, the corner hole 14 of rib plate type heat exchange plates 1*c* and 1*d* and corner hole adjacent edge zone 16 at the upper plate plane height 4 are distributed diagonally in the first end zone 7 and second end zone 8, the corner hole adjacent edge zone 16 around corner hole 14 is connected via the incline intermediate zone 10 on centerline 6 with the lower plate plane height 5; the corner hole 15 of rib plate type heat exchange plates 1*c* and 1*d* and corner hole adjacent edge zone 17 at the lower plate plane height 5 are distributed diagonally in the first end zone 7 and second end zone 8, the corner hole adjacent edge zone 17 around corner hole 15 is connected via the incline intermediate zone 10 on centerline 6 with the upper plate plane height 4.

Referring now to FIG. 19, the rib plate type heat exchange plate 1*d* is turned on the plane by 180° and is stacked with rib plate type heat exchange plate 1*c* and be connected and sealed in succession in that order to form heat exchange core 22, in the heat exchange core 22 the corner holes 14 and 15 will form the corner hole flow passage 41; on the heat exchange core 22 formed by rib plate type heat exchange plates 1*c* and 1*d* is provided with outer baffle 24, which is divided into front outer baffle 24 and rear outer baffle 24, and on the front outer baffle 24 there is a through hole and the nozzle 23.

Embodiment 4

Figure 16:
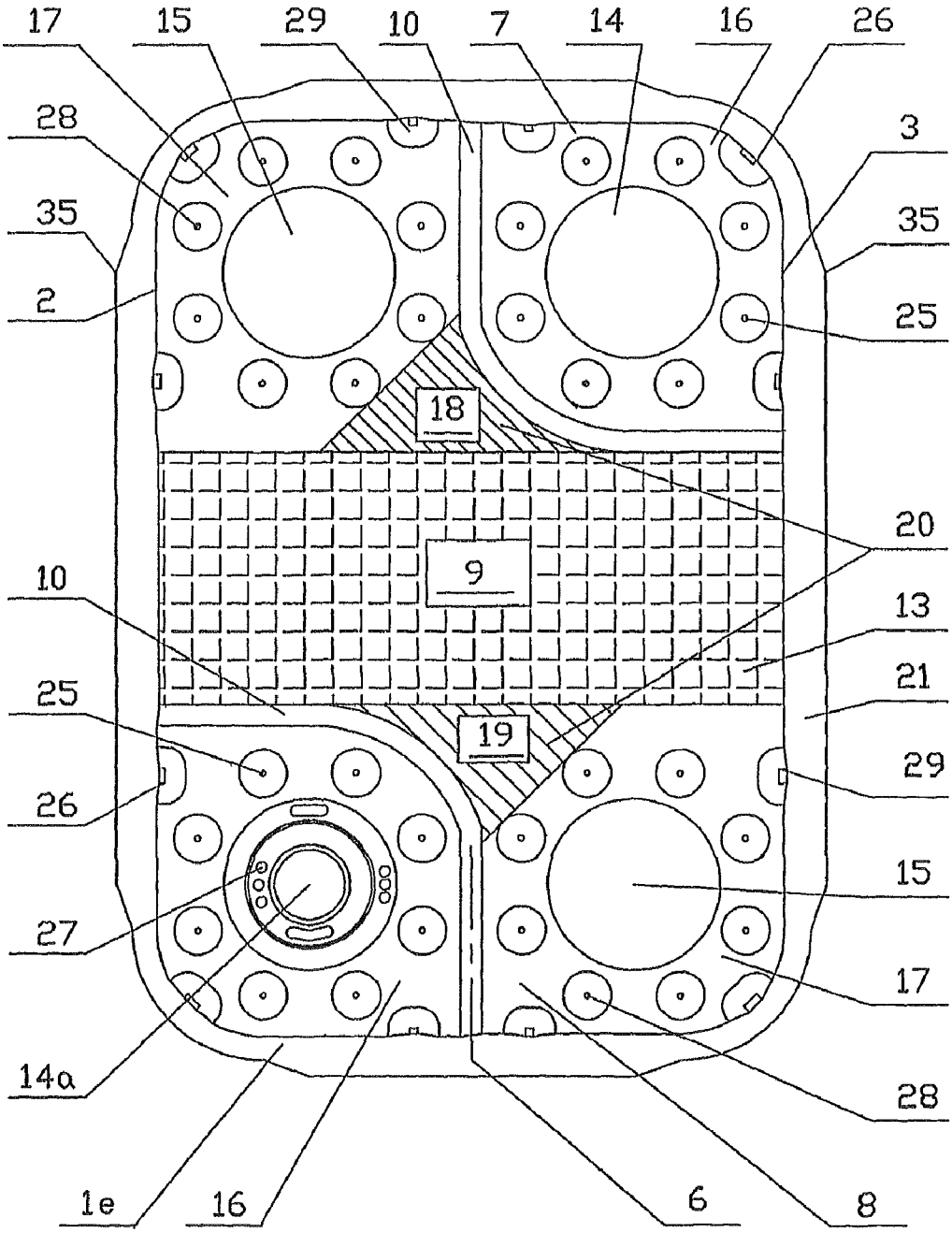
FIG. 16. is a view like FIG. 2 in Embodiment 4.
Figure 17:
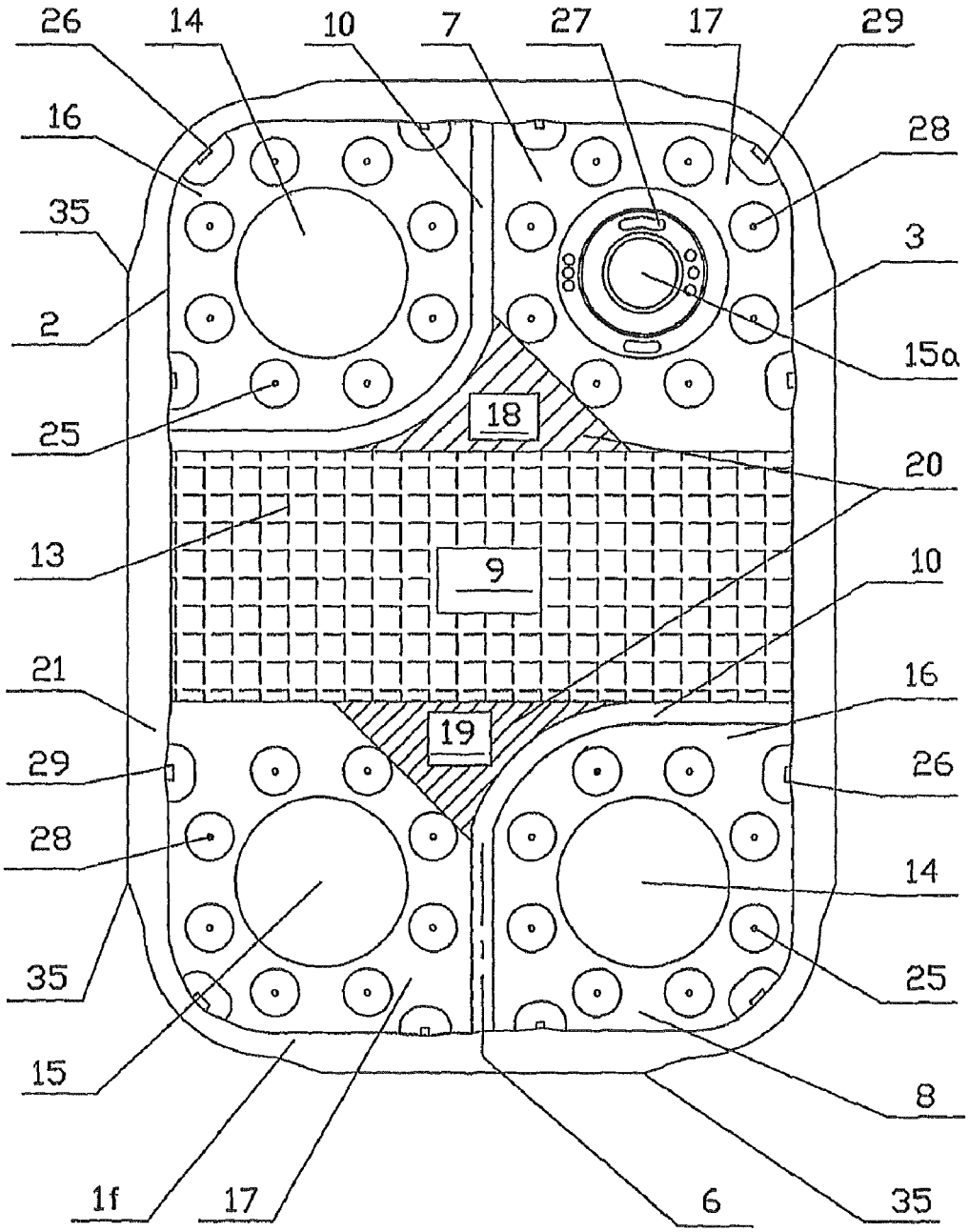
FIG. 17. is a view similar to FIG. 2 illustrating another rib plate type heat exchange plate in Embodiment 4

Embodiment 4 is similar to Embodiment 2, with the following differences:

Referring now to FIGS. 16 and 17, the corner holes 14, 14*a* and 15, 15*a* used as the inlet and outlet of the same fluid of rib plate type heat exchange plates 1*e* and 1*f* and the corner hole adjacent edge zones 16 and 17 around these corner holes 14, 14*a* and 15, 15*a* at the same plane height are all located in the diagonal positions of rib plate type heat exchange plates 1*e* and 1*f*, and the heat exchange media will flow and exchange heat mutually in a diagonal pattern in the rib plate type heat exchanger formed by rib plate type heat exchange plates 1*e* and 1*f*.

Referring now to FIGS. 16 and 17, the corner holes 14 and 14*a* of rib plate type heat exchange plates 1*e* and 1*f* and the corner hole adjacent edge zone 16 at upper plate plane height 4 are distributed diagonally in first end zone 7 and second end zone 8, the corner hole adjacent edge zone 16 around corner holes 14 and 14*a* is connected via the incline intermediate zone 10 on centerline 6 with the lower plate plane height 5; the corner holes 15 and 15*a* of rib plate type heat exchange plates 1*e* and 1*f* and corner hole adjacent edge zone 17 at the lower plate plane height 5 are distributed diagonally in the first end zone 7 and second end zone 8, the corner hole adjacent edge zone 17 around corner hole 15 and 15*a* is connected via the incline intermediate zone 10 on centerline 6 with the upper plate plane height 4.

Referring now to FIG. 18, the rib plate type heat exchange plate 1*f* is turned on the plane by 180° and is stacked with rib plate type heat exchange plate 1*e* and be connected and sealed in succession in that order to form heat exchange core 22, in the heat exchange core 22 the corner holes 14 and 15 will form the corner hole flow passage 41; the corner holes 14*a* and 15*a* will form corner hole flow passage 41*a*, on the heat exchange core 22 formed by rib plate type heat exchange plates 1*e* and 1*f* is provided with outer baffle 24, which is divided into front outer baffle 24 and rear outer baffle 24, and on the front outer baffle 24 there is a through hole and the nozzle 23.

In the above-mentioned Embodiment 3 and Embodiment 4, in rib plate type heat exchange plates 1*a* and 1*b* as well as rib plate type heat exchange plates 1*e* and 1*f*, the corner holes 14, 14*a* and 15, 15*a* used as the inlet and outlet of the same fluid and the corner hole adjacent edge zones 16 and 17 around these corner holes 14, 14*a* and 15, 15*a* at upper plate plane height are distributed diagonally in first end zone and second end zone, and the heat exchange media will flow and exchange heat mutually in a diagonal pattern in the rib plate type heat exchanger formed by rib plate type heat exchange plates 1*a* and 1*b* and rib plate type heat exchange plates 1*e* and 1*f*.

Referring now to FIGS. 1, 10, 18 and 19, a rib plate type heat exchanger, consisting of the rib plate type heat exchange plates 1; 1*a* and 1*b*; The heat exchange core 22 formed by 1*c*, 1*d*; 1*e* and 1*f*, nozzle 23 and outer baffle 24, which can be divided into front outer baffle 24 and rear outer baffle 24; the nozzles 23 are distributed on front outer baffle 24 and rear outer baffle 24; these rib plate type heat exchange plates 1; 1*a* and 1*b*; 1*c*, 1*d*; 1*e* and 1*f* forming the heat exchange core 22 are respectively connected and sealed usually by welding or brazing and by using adhesives or sealing gaskets between them.

Referring now to FIGS. 2, 3, 5, 6, 7, 8, 9, 11, 12, 13, 14, 15, 16 and 17, on rib plate type heat exchange plates 1; 1*a* and 1*b*; 1*c*, 1*d*; 1*e* and 1*f* there are the first end zone 7, second end zone 8 and central heat exchange zone 9, and the first edge zone 2 and second edge zones 3 around each of the rib plate type heat exchange plates 1; 1*a* and 1*b*; 1*c*, 1*d*; 1*e* and 1*f* are ring enclosed sealing bevel 21, each of the rib plate type heat exchange plates extends between first edge zone 2 and second edge zone 3 and parallel with the upper plate plane 4 and lower plate plane 5, in the first end zone 7 of each rib plate type heat exchange plate there is the first distribution zone 18, and in the second end zone 8 there is the second distribution zone 19, in the first distribution zone 18 and second distribution zone 19 there are flow guide ribs 20, the central heat exchange zone 9 extends between the first edge zone 2 and second edge zone 3 from the first end zone 7 towards the second end zone 8, on the central heat exchange zone 9 there are heat exchange ribs 13, in the central heat exchange zone 9 and first and second distribution zones 18 and 19, the heat exchange ribs 13 and flow guide ribs 20 are at equal height and they are also at equal height as the flow channel height between the rib plate type heat exchange plates in the heat exchange core, the central heat exchange zone 9 and the first and second distribution zones 18 and 19 are on the same plane and extend at lower plate plane height 5, the heat exchange ribs 13 are connected and fixed together on the plane of the central heat exchange zone 9, the flow guide ribs 20 are connected and fixed together on the planes of the first distribution zone 18 and second distribution zone 19, in the first end zone 18 and second end zone 19 of each of the rib plate type heat exchange plates, corner holes 14, 14*a* and 15, 15*a* penetrate through the rib plate type heat exchange plates to form through holes, these corner holes 14, 14*a* and 15, 15*a* are respectively surrounded by corner hole adjacent edge zones 16 and 17 with upper plate plane height 4 and lower plate plane height 5, these corner hole adjacent edge zones 16 and 17 respectively form pairs in the first end zone 7 and the second end zone 8, these corner hole adjacent edge zones 16 and 17 in the first end zone 7 and the second end zone 8 respectively extends at the upper plate plane height 4 and the lower plate plane height 5, between these corner hole adjacent edge zones 16 and 17 and between corner hole adjacent edge zone 16 with upper plate plane height 4 and the central heat exchange zone 9, and also between the corner hole adjacent edge zones 16 with upper plate plane height 4 and the first distribution zone 18 and second distribution zone 19, a incline intermediate zone extends, the corner hole adjacent edge zone 16 extending at upper plate plane height 4 is in contact with the lower plate plane height 5 via the incline intermediate zone 10, and the corner hole adjacent edge zone 17 extending at the lower plate plane height 5 is in contact with the upper plate plane height 4 via the incline intermediate zone 10.

Referring now to FIGS. 6, 7, 8, 9, 11, 12, 13, 16, 17 and 18, on each of the rib plate type heat exchange plates in the corner hole adjacent edge zone 16 at the upper plate plane height 4 there is a ring of concave edge bubbles 25, with the bottom of concave edge bubbles 25 reaching the lower plate plane height 5; and in the corner hole adjacent edge zone 17 at lower plate plane height 5 there is a ring of convex edge bubbles 28, with the top of convex edge bubbles 28 reaching the upper plate plane height 4.

As shown in Attached FIGS. 6, 7, 8, 9, 11, 12, 13, 16, 17 and 18, on each of the rib plate type heat exchange plates, at the boundary between the corner hole adjacent edge zone 16 at the upper plate plane height 4 and the ring enclosed sealing bevel 21 of each of the rib plate type heat exchange plates, there are concave pits 26, with the bottom of the concave pits 26 reaching the lower plate plane height 5; at the boundary between the corner hole adjacent edge zone 17 at the upper plate plane height 5 and the ring enclosed sealing bevel 21 of each of the rib plate type heat exchange plates, there are convex bosses 29, with the top of the convex bosses 29 reaching the upper plate plane height 4.

Referring now to FIGS. 6, 7, 8, 9, 10, 11, 12, 13, 16, 17 and 18, on each of the rib plate type heat exchange plates, in the straight section of sealing bevel 21 along the edge of the first edge zone 2 and second edge zone 3, there is turned up edge structure 35 to prevent deformation of this sealing bevel 21 during fabrication, however, on each of the rib plate type heat exchange plates, at the four round corners of sealing bevel 21 along the edge of the first edge zone 2 and second edge zone 3, there is no such turned up edge structure 35.

Referring now to FIGS. 2, 4, 5, 6, 7, 10, 11, 12, 14, 15, 16 and 17, the heat exchange ribs 13 and flow guide ribs 20 can be one of the five forms: sawtooth type, straight type, perorated type, corrugated type and shutter type, or the combination of them according to the heat exchange media properties and heat exchange requirements;

Referring now to FIGS. 6, 11, 16 and 17, on the same rib plate type heat exchange plate 1*a* and 1*b* as well as 1*e* and 1*f*, in the corner hole adjacent edge zones 16 and 17, media distributor 27 is provided in at least one of the corner hole adjacent edge zone 16 or 17, on the same rib plate type heat exchange plate 1*a* and 1*b* as well as 1*e* and 1*f*, in the corner hole adjacent edge zone 16 or 17 with media distributor 27, the diameter of the corner holes 14*a* and 15*a* is smaller than that of corner holes 14 and 15 in the other corner hole adjacent edge zone 16 or 17 without media distributor 27.

Referring now to FIGS. 7 and 8, on rib plate type heat exchange plate 1*a* and 1*e*, in the corner hole adjacent edge zone 16 with media distributor 27, the corner hole 14*a* and adjacent edge zone 16 are at the lower plate plane height 4, on the adjacent edge zone 16 are provided with ring concave groove 32, with the opening 34 of the concave groove at the lower plate plane height 4, and the bottom of the concave groove at the upper plate plane height 5, the edges 33 and 31 of the concave groove 32 are curved, at the inner and outer edges 33 and 31 of the concave groove there is respectively one or more small holes 30, these small holes are not in the same direction, and also, the positions of these equally spaced small holes 30 are aligned with the equally spaced small holes 30 on the inner edge 38 and outer edge 36 on the adjacent rib plate type heat exchange plates 1*b* and 1*f*.

Referring now to FIGS. 12 and 13, on rib plate type heat exchange plate 1*b* and 1*f*, in the corner hole adjacent edge zone 17 with media distributor 27, the corner hole 15*a* and adjacent edge zone 17 are at the upper plate plane height 5, on the adjacent edge zone 17 are provided with ring concave groove 37, with the opening 39 of the concave groove at the upper plate plane height 5, and the bottom of the concave groove at the lower plate plane height 4, the edges 38 and 36 of the concave groove 37 are curved, at the inner and outer edges 38 and 36 of the concave groove there is respectively one or more small holes 30, these small holes are not in the same direction, and also, the positions of these equally spaced small holes 30 are aligned with the equally spaced small holes 30 on the inner and outer edges 33 and 31 on the adjacent rib plate type heat exchange plates 1*a* and 1*e*.

Referring now to FIGS. 2, 6 and 11, in rib plate type heat exchange plates 1 and 1*a* and 1*b*, the corner holes 14, 14*a* or 15, 15*a* used as the inlet and outlet of the same fluid and the corner hole adjacent edge zone 16 or 17 around these corner holes 14 and 14*a* or 15 and 15*a* with the same plane height are respectively located in the single same side in the first end zone 7 and second end zone 8.

Referring now to FIGS. 14, 15, 16 and 17, on rib plate type heat exchange plates 1*c* and 1*d* as well as 1*e* and 1*f*, the corner holes 14, 14*a* or 15, 15*a* used as the inlet and outlet of the same fluid and the corner hole adjacent edge zone 16 or 17 around these corner holes 14 and 14*a* or 15 and 15*a* with the same plane height are respectively located in the single same side in the first end zone 7 and second end zone 8.

Referring now to FIG. 5, at the plane of the second distribution zone 19 are provided with flow guide ribs 20.

Figure 10:
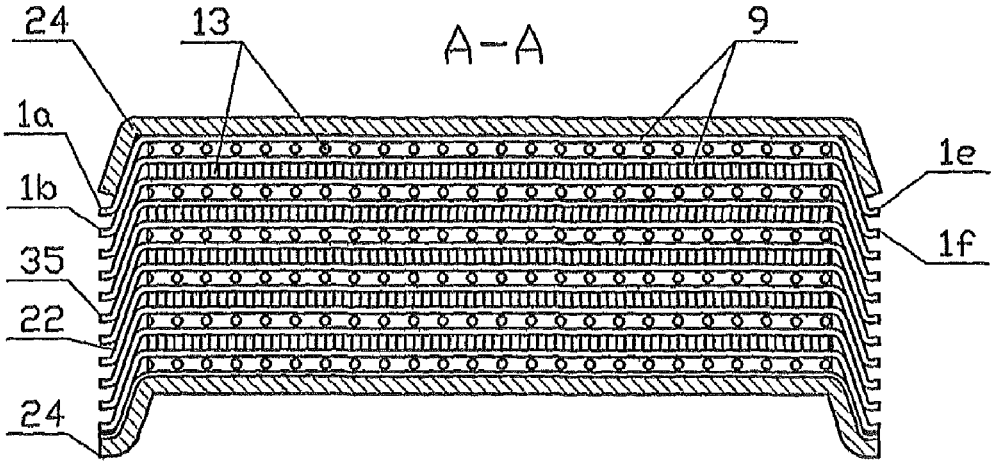
FIG. 10. is a transverse sectional view taken substantially as indicated along the line A-A of FIG. 1 with the rib plate type heat exchange plates in Embodiment 2 or Embodiment 4.

Referring now to FIG. 10, on rib plate type heat exchange plates 1*a* and 1*b* as well as 1*e* and 1*f* there are heat exchange ribs 13 at the plane of the central heat exchange zone 9, and also on heat exchange core 22, both front outer baffle 24 and rear outer baffle 24 are of flat bottom and are sealed along the edge with a bevel.

Referring now to FIGS. 18 and 19, a number of rib plate type heat exchange plates 1*a* and 1*b* as well as 1*e* and 1*f* with media distributor 27 are stacked together as required and connected and sealed to form the heat exchange core 22; or a number of rib plate type heat exchange plates 1 and 14 and 15 are without media distributor 27 are stacked together as required and connected and sealed to form the heat exchange core 22; as in each of the rib plate type heat exchange plates, the top of the corner hole adjacent edge zone 16 in the first end zone 7 at upper plate plane height 4 is in close contact with the back of the corner hole adjacent edge zone 17 in the second end zone 8 at lower plate plane height 5 of another adjacent rib plate type heat exchange plate, also on each of the rib plate type heat exchange plates, the back of the corner hole adjacent edge zone 17 in the first end zone 7 at the lower plate plane height 5 is in close contact with the top of the corner hole adjacent edge zone 16 in the second end zone 8 at upper plate plane height 4 of another adjacent rib plate type heat exchange plate, and also, as each of the corner hole adjacent edge zones 16 and 17 are directly connected with the ring enclosed sealing bevel 21 of the first edge zone 2 and second edge zone 3 at the edge of each of the rib plate type heat exchange plates at different plane heights 4 and 5, when the rib plate type heat exchange plates are stacked and connected and sealed together, corner hole flow channel spaces at twice the rib height will be formed between the corner hole channels 41 and 41*a* and the central heat exchange zone 9. Such corner hole flow channel space will enhance the turbulence and erosive action of heat exchange media in this space, to avoid or mitigate stagnation of heat exchange media around the corner holes and deposit of foreign matter. Also, the corner hole channel space so formed can help evenly distribute the heat exchange media to central heat exchange zone at various layers and can also reduce the resistance to fluid.

Referring now to FIG. 18, a number of rib plate type heat exchange plates 1*a* and 1*b* and a number of rib plate type heat exchange plates 1*e* and 1*f* are stacked together as required and connected and sealed to form the heat exchange core 22; on rib plate type heat exchange plates 1*a* and 1*b* as well as rib plate type heat exchange plates 1*e* and 1*f*, the corner holes 14*a* and 15*a* of respective media distributor 27 will be stacked together to form the corner hole flow passage 41*a*, in the heat exchange core 22, other corner holes 14 and 15 will form corner hole flow passage 41, when the rib plate type heat exchange plates 1*a* and 1*b* as well as rib plate type heat exchange plates 1*e* and 1*f* are stacked together, the top of the corner hole adjacent edge zone 16 of rib plate type heat exchange plates 1*a* and rib plate type heat exchange plate 1*e* will be in close contact with the back of the corner hole adjacent edge zone 17 on rib plate type heat exchange plate 1*b* and rib plate type heat exchange plate 1*f*, so that the concave groove 32 on rib plate type heat exchange plate 1*a* and rib plate type heat exchange plate 1*e* and the concave groove 37 on rib plate type heat exchange plate 1*b* and rib plate type heat exchange plate 1*f* will form a ring equalizing flow channel 40, and the equally distributed heat exchange medium will flow via the corner hole flow passage 14*a* into the equally spaced small holes 30 on the respective concave groove inner edges 33 and 38 of the rib plate type heat exchange plate 1*a* and 1*b* and rib plate type heat exchange plate 1*e* and 1*f*, and then into this ring equalizing flow channel 40, then out of the ring equalizing flow channel 40 from the equally spaced small holes 30 on the respective concave groove outer edges 31 and 36 of the rib plate type heat exchange plate 1*a* and 1*b* and rib plate type heat exchange plate 1*e* and 1*f*, and finally to flow guide ribs 20 and heat exchange ribs 13, so as to achieve the purpose of evenly distribute the heat exchange medium in the flow channels between the rib plate type heat exchange plates 1*a* and 1*b* and rib plate type heat exchange plates 1*e* and 1*f*.

Referring now to FIG. 18, it is also shown that the concave edge bubbles 25 in the corner hole adjacent edge zone 16 on the rib plate type heat exchange plate 1*a* and rib plate type heat exchange plate 1*e* will be fixed in tight contact with the convex edge bubbles 28 in the corner hole adjacent edge zone 17 on the rib plate type heat exchange plate 1*b* and rib plate type heat exchange plate 1*f*; also, the convex edge bubbles 28 in the corner hole adjacent edge zone 17 on rib plate type heat exchange plate 1*a* and rib plate type heat exchange plate 1*e* will be fixed in tight contact with the convex edge bubbles 25 in the corner hole adjacent edge zone 16 on rib plate type heat exchange plate 1*b* and rib plate type heat exchange plate 1*f*.

Referring now to FIG. 18, it is also shown that the top of convex bosses 29 on rib plate type heat exchange plate 1*a* and rib plate type heat exchange plate 1*e* will be connected and fixed with the bottom of the concave pits 26 on rib plate type heat exchange plate 1*b* and rib plate type heat exchange plate 1*f*, and the bottom of concave pits 26 on rib plate type heat exchange plate 1*a* and rib plate type heat exchange plate 1*e* will be connected and fixed with the top of the concave pits 29 on rib plate type heat exchange plate 1*b* and rib plate type heat exchange plate 1*f*.

What is claimed is:

1. A rib plate type heat exchanger comprising:

a heat exchange core formed by a plurality of rib plate type heat exchange plates and an outer baffle and a plurality of nozzles, wherein the plurality of rib plate type heat exchange plates forming the heat exchange core are connected and sealed by at least one of welding and brazing and by using at least one of adhesives and sealing gaskets between the plurality of rib plate type heat exchange plates;

a first end zone, a second end zone, and a central heat exchange zone positioned on the plurality of rib plate type heat exchange plates, wherein a ring enclosed sealing bevel is adjacent the first edge zone and the second edge zone along the edge of the plurality of rib plate type heat exchange plates, further wherein the plurality of rib plate type heat exchange plates extend between the first edge zone and the second edge zone and are parallel with an upper plate plane and a lower plate plane;

a first distribution zone in the first end zone and a second distribution zone in the second end zone, the first distribution zone and the second distribution zones having a plurality of flow guide ribs; and a central heat exchange zone extending between a first edge zone and a second edge zone from the first end zone to the second end zone, wherein a plurality of heat exchange ribs are positioned on the central heat exchange zone, the plurality of heat exchange ribs in the central heat exchange zone being of the same height as the plurality of flow guide ribs positioned on the first distribution zone and the second distribution zone and are also at the same height as a plurality of flow channels between the plurality of rib plate type heat exchange plates in the heat exchange core, further wherein the central heat exchange zone and the first distribution zone and the second distribution zone are at the same plane and extend at the lower plate plane height;

wherein the heat exchange ribs are connected and fixed together with the plane of the central heat exchange zone;

wherein the plurality of flow guide ribs are connected and fixed together with the planes of the first distribution zone and the second distribution zone;

wherein a plurality of corner holes in the first end zone and second end zone of the plurality of rib plate type heat exchange plates penetrate the plurality of rib plate type heat exchange plates to form a plurality of through holes, further wherein the plurality of corner holes are surrounded respectively by a first corner hole adjacent edge zone and a second corner hole adjacent edge zone at the upper plate plane height and the lower plate plane height;

wherein the first corner hole adjacent edge zone and the second corner hole adjacent edge zone form pairs in the first end zone and the second end zone;

wherein the first corner hole adjacent edge zone and the second corner hole adjacent edge zone extend respectively in the first end zone and the second end zone at the upper plate plane height and the lower plate plane height;

wherein an incline intermediate zone extends between the first corner hole adjacent edge zone and the second corner hole adjacent edge zone, between the plurality of corner holes adjacent the first and second corner hole adjacent edge zones at the upper plate plane height and the central heat exchange zone, and also between the first and second corner hole adjacent edge zones at the upper plate plane height and the first distribution zone and the second distribution zone;

wherein the first and second corner hole adjacent edge zones extending at the upper plate plane height are in contact with the lower plate plane height via the incline intermediate zone, and the first and second corner hole adjacent edge zones extending at the lower plate plane height are in contact with the upper plate plane height via the incline intermediate zone;

wherein a media distributor is provided in at least one of the first corner hole adjacent the edge zone and the second corner hole adjacent edge zone on a same rib type heat exchange plate of the plurality of rib type heat exchange plates;

wherein the plurality of corner holes of the plurality of rib plate type heat exchange plates and the first and second corner hole adjacent edge zones are at the same plane height;

wherein a ring concave groove is provided on the first and second corner hole adjacent edge zones, further wherein an opening of the ring concave groove is at the same plane height as the first and second corner hole adjacent edge zones, a bottom of the ring concave groove is at the plane height of an adjacent rib plate type heat exchange plate of the plurality of rib plate type heat exchange plates, an edge of the ring concave groove being curved, and at an inner edge and an outer edge of the ring concave groove there are a plurality of small holes, the plurality of small holes at the inner edge and the outer edge being arranged in a staggered pattern;

wherein on an adjacent rib plate type heat exchange plate, the plurality of small holes at the inner edge are aligned with each other and the plurality of small holes at the outer edge are aligned with each other.

2. A rib plate type heat exchanger as claimed in claim 1, wherein on the plurality of rib plate type heat exchange plates, in the first and second corner hole adjacent edge zones at the upper plate plane height, there is a ring of concave edge bubbles, with a bottom of the concave edge bubbles reaching the lower plate plane height and in the first and second corner hole adjacent edge zones at the lower plate plane height, there is a ring of convex edge bubbles, with a top of the convex edge bubbles reaching the upper plate plane height.

3. A rib plate type heat exchanger as claimed in claim 1, wherein, on the plurality of rib plate type heat exchange plates, at a boundary between the first and second corner hole adjacent edge zones at the upper plate plane height and the ring enclosed sealing bevel along the edge of the plurality of rib plate type heat exchange plates there are respectively a plurality of concave pits, with a bottom of the plurality of concave pits reaching the lower plate plane height and at the boundary between the first and second corner hole adjacent edge zones at the lower plate plane height and the ring enclosed sealing bevel along the edge of the plurality of rib plate type heat exchange plates there are a plurality of convex bosses, with a top of the plurality of convex bosses reaching the upper plate plane height.

4. A rib plate type heat exchanger as claimed in claim 1, wherein a turned up edge structure is provided on a straight section of the ring enclosed sealing bevel along the edge of the first corner hole adjacent edge zone and the second corner hole adjacent edge zone of the plurality of rib plate type heat exchange plates.

5. A rib plate type heat exchanger as claimed in claim 1, wherein the plurality of heat exchange ribs and the plurality of flow guide ribs are in a form of at least one selected from the group consisting of: sawtooth type, straight type, perorated type, corrugated type and shutter type, or the combination of them according to the heat exchange media properties and heat exchange requirements.

6. A rib plate type heat exchanger as claimed in claim 1, wherein in the plurality of rib plate type heat exchange plates, the plurality of corner holes are used as an inlet and an outlet of the same fluid and the first and second corner hole adjacent edge zones surrounding the plurality of corner holes at the same plane height are located on the same side respectively in the first end zone and the second end zone.

7. A rib plate type heat exchanger as claimed in claim 1, wherein in the plurality of rib plate type heat exchange plates, the plurality of corner holes used as the inlet and the outlet of the same fluid and the first and second corner hole adjacent edge zones surrounding the plurality of corner holes at the same plane height are located diagonally in the first end zone and the second end zone.

* * * * *